US005436081A

United States Patent [19]

Ueda et al.

[11] Patent Number: 5,436,081

[45] Date of Patent: Jul. 25, 1995

[54] PLATED ALUMINUM SHEET HAVING IMPROVED SPOT WELDABILITY

[75] Inventors: Naotaka Ueda, Wakayama; Yoshihiko Hoboh, Tokyo; Masanori Tsuji; Kazuyuki Fujita, both of Wakayama, all of Japan

[73] Assignees: Sumitomo Metal Industries, Ltd., Osaka; Sumitomo Light Metal Industries, Ltd., Tokyo, both of Japan

[21] Appl. No.: 191,356

[22] Filed: Feb. 2, 1994

Related U.S. Application Data

[63] Continuation of Ser. No. 835,870, Feb. 18, 1992, abandoned.

[30] Foreign Application Priority Data

Feb. 18, 1991 [JP] Japan ..... 3-023552
May 20, 1991 [JP] Japan ..... 3-114883

[51] Int. Cl.[6] ..... B32B 15/20
[52] U.S. Cl. ..... 428/650; 428/654
[58] Field of Search ..... 428/650, 651, 652, 653, 428/658, 654, 686, 636; 205/139, 153, 213

[56] References Cited

U.S. PATENT DOCUMENTS

| | | | |
|---|---|---|---|
| 1,627,900 | 5/1927 | Hewitson . | |
| 1,791,642 | 2/1931 | Schulte | 205/213 |
| 2,162,789 | 6/1938 | Raub | 428/652 |
| 2,233,410 | 3/1940 | Frasch | 428/652 |
| 2,676,916 | 4/1954 | Zelley | 204/33 |
| 2,847,371 | 8/1958 | Topelian | 428/651 |
| 2,898,230 | 8/1959 | Bulloff | 428/651 |
| 3,098,804 | 7/1963 | Wittrock | 204/41 |
| 3,284,323 | 11/1966 | Leloup | 204/38 |
| 3,359,189 | 12/1967 | Cooke et al. | 204/28 |
| 3,551,122 | 12/1970 | Gulla | 428/650 |
| 3,765,847 | 10/1973 | Behl | 428/650 |
| 3,909,209 | 9/1975 | Kruper et al. | 29/183.5 |
| 3,915,811 | 10/1975 | Tremmel et al. | 205/213 |
| 3,920,413 | 11/1975 | Lowery | 29/197 |
| 3,969,199 | 7/1976 | Berdan et al. | 204/33 |
| 4,097,347 | 6/1978 | Packer | 204/109 |
| 4,157,941 | 6/1979 | Donakowski et al. | 205/213 |
| 4,169,770 | 10/1979 | Cooke et al. | 204/28 |
| 4,196,060 | 4/1980 | Patrie et al. | 205/139 |
| 4,221,845 | 9/1980 | Koehler | 428/652 |
| 4,273,837 | 6/1981 | Coll-Palagos | 428/650 |
| 4,437,944 | 3/1984 | Bruno et al. | 204/27 |
| 4,495,008 | 1/1985 | Bruno et al. | 148/31.5 |
| 4,681,668 | 7/1987 | Davies et al. | 204/28 |
| 4,940,639 | 7/1990 | Ohshima et al. | 428/659 |
| 4,969,980 | 11/1990 | Yoshioka et al. | 204/28 |
| 4,975,337 | 12/1990 | Hyner et al. | 428/648 |
| 5,015,340 | 5/1991 | Colombier et al. | 204/28 |

FOREIGN PATENT DOCUMENTS

| | | | |
|---|---|---|---|
| 834514 | 4/1976 | Belgium . | |
| 884514 | 1/1981 | Belgium . | |
| 1496225 | 9/1967 | France . | |
| 2266753 | 10/1975 | France . | |
| 51-64429 | 6/1976 | Japan . | |
| 52-24909 | 2/1977 | Japan | 428/651 |

(List continued on next page.)

OTHER PUBLICATIONS

T. E. Such et al., "An Improvement in the Zincate Method for Plating on Aluminum," *Plating*, 52(10):1027–1034 (1965) no month available.

(List continued on next page.)

*Primary Examiner*—John Zimmerman
*Attorney, Agent, or Firm*—Burns, Doane, Swecker & Mathis

[57] ABSTRACT

A plated aluminum sheet has improved spot weldability and press-formability and is suitable for use in the manufacture of automobile bodies. The aluminum sheet has a plated coating of a metal having a melting point of about 700° C. or above, e.g., Cr, Mn, Fe, Co, or Ni, an alloy of two or more of these metals, or a Zn alloy with at least one of these metals, on one or both surfaces thereof.

13 Claims, No Drawings

FOREIGN PATENT DOCUMENTS

| | | | |
|---|---|---|---|
| 54-41550 | 12/1979 | Japan . | |
| 57-20399 | 2/1982 | Japan . | |
| 58-81961 | 5/1983 | Japan . | |
| 59-200793 | 11/1984 | Japan | 205/153 |
| 61-157693 | 7/1986 | Japan . | |
| 2-19488 | 1/1990 | Japan . | |
| 2-19489 | 1/1990 | Japan . | |
| 2-19490 | 1/1990 | Japan . | |
| 3-146693 | 6/1991 | Japan . | |
| 5055 | 3/1908 | United Kingdom | 205/213 |
| 290903 | 5/1928 | United Kingdom . | |
| 877385 | 9/1961 | United Kingdom | 205/213 |
| 1133679 | 11/1968 | United Kingdom . | |
| 2179058 | 2/1987 | United Kingdom . | |

OTHER PUBLICATIONS

G. A. DiBari, "Plating on Aluminum Pretreatments and Corrosion Performance," *Plating and Surface Finishing,* 64(5):68–74 (1977) no month available.

C. Milovanovic et al., "Direct Nickel Plating on Aluminum and its Alloys," *Chemical Abstracts,* 72(10):530 (1970) no month available.

W. Meyer, "Electroplating on Aluminum," *The Monthly Review,* pp. 269–278, 273–274, 277 (1946), no month.

PLATED ALUMINUM SHEET HAVING IMPROVED SPOT WELDABILITY

This application is a continuation of application Ser. No. 07/835,780, filed Feb. 18, 1992, now abandoned.

BACKGROUND OF THE INVENTION

This invention relates to a plated aluminum or aluminum alloy sheet which as improved spot weldability and which is suitable for use in the manufacture of automobile bodies.

Because of a low specific weight of 2.7 (which is about one-third that of iron), aluminum sheet including aluminum alloy sheet has begun to be employed in automobile bodies, particularly automobile hoods, for the purposes of saving weight and thereby reducing fuel consumption.

A major problem involved in the use of aluminum sheet in such applications is attributable to its spot weldability which is inferior to that of steel sheet conventionally used for automobile bodies.

Compared to steel, aluminum has significantly poorer heat generation efficiency in resistance welding such as spot welding since it is difficult to generate heat due to its low electrical resistivity, which is on the order of one-third to one-fourth that of steel, and the generated heat easily escapes due to its high thermal conductivity, which is on the order of 2 to 3 times that of steel. As a result, spot welding of aluminum sheets requires a current which is about four times as large as that required for spot welding of steel sheet.

Furthermore, a firm oxide film readily forms on the surface of aluminum or aluminum alloy, and this film is responsible for the formation of weld spots having inconsistent strength, resulting in poor reliability of spot welding.

Since a large current is passed, as described above, between the aluminum sheets and the electrodes of a spot welder, which are usually made of Cu or a Cu alloy, the surface of the electrodes tends to be rapidly contaminated with aluminum to form a brittle Cu—Al alloy. As a result, the service life of the electrodes (the number of weldable spots before re-grinding of the electrodes becomes necessary) is as small as between about 200 and about 300 spots, which is much smaller than the service life of 10,000 spots or more obtained with steel sheet.

Accordingly, there is a great need to improve the spot weldability of aluminum sheet, and various pretreatment methods have been attempted in the prior art for this purpose.

For example, a relatively simple pretreatment method known in the prior art is to remove the oxide film formed on the surface of aluminum sheet by grinding with Emery paper or a wire brush. This method is variable with respect to the extent that it can remove the oxide film, so it cannot improve the spot weldability to a desired level.

Another known method is to pretreat aluminum sheet by chemical conversion treatment such as phosphate chromating prior to spot welding. The method, however, does not produce a sufficient improvement in spot weldability. It is also proposed to improve spot weldability by removing the surface oxide film by the washing action of arc. However, this pretreatment method is impractical since the incorporation of the pretreatment method prior to spot welding in a manufacturing line of automobile bodies greatly increases the equipment costs.

Japanese Patent Application Laid-Open No. 53-6252(1978) and Japanese Patent Publication No. 54-41550(1979) disclose interposing a thin zinc film at the weld interface, i.e., between two aluminum sheets to be spot welded, in order to improve spot weldability. The thin zinc film is either a zinc foil inserted in the interface or a zinc coating or plating formed on one or both of the aluminum sheets.

According to that method, it is expected that the efficiency of heat generation can be improved by the zinc film interposed between the aluminum sheets. However, the improvement depends on the thickness of the zinc film, and a sufficient effect cannot be obtained with a zinc film having a thickness of about 10 μm or less, which approximately corresponds to a weight of about 70 $g/m^2$ or less. Furthermore, due to the fact that the melting point of zinc (420° C.) is lower than that of aluminum (660° C.), the thin zinc film is melted prior to melting of aluminum sheets upon passage of welding current and the molten zinc extends over the weld interface, resulting in the diffusion of current. Therefore, that method requires an increased current compared to a conventional spot welding method for aluminum sheets, and the heat generated at the weld interface between the aluminum sheets and electrodes is increased, thereby leading to a diminished service life of the electrodes.

Aluminum also suffers from rather poor press-formability. Aluminum sheet has a local deformability lower than that of steel sheet and is apt to fracture when a concentrated strain is imposed thereon. In addition, the surface sliding properties of aluminum sheet are inferior to those of steel sheet, and this fact is also responsible for the poor press-formability of aluminum sheet.

SUMMARY OF THE INVENTION

It is an object of this invention to improve the spot weldability of aluminum sheet in such a manner that it can be welded for the manufacture of automobile bodies with an efficiency comparable to the welding efficiency of mild steel sheet which has conventionally been used for automobile bodies.

A more specific object of the invention is to increase the number of weldable spots of aluminum sheet in continuous spot welding before it becomes necessary to re-grind the electrodes. The number of weldable spots is presently as low as between about 200 and about 300 spots for aluminum sheet and greatly interferes with the manufacture of automobile bodies from aluminum sheet.

A further object of the invention is to improve the surface sliding properties and hence the press-formability of aluminum sheet.

In general, the present invention provides a plated aluminum sheet having improved spot weldability which comprises an aluminum sheet having on one or both surfaces of plated coating of a metal which has a melting point of about 700° C. or above.

DESCRIPTION OF THE INVENTION

The term "aluminum sheet" used herein encompasses any sheet of aluminum metal or an aluminum alloy which comprises Al as the major alloying element. Examples of aluminum alloys are Al—4.5 Mg, Al—5Cu, and Al—4Cu—5Si. The aluminum sheet may be either in the cut sheet form or in the form of coiled or uncoiled continuous strip.

An important feature of this invention is to coat the surface of aluminum sheet with a plating of a particular metal. As described above, the surface of aluminum sheet is covered with a firm oxide film, which increases the contact resistance of the aluminum sheet, thereby degrading the spot weldability thereof. Pickling or other pretreatment to remove the oxide film is accompanied by ready regeneration of an oxide film during storage before spot welding, leading to a substantial loss of its effect on spot weldability.

According to the present invention, aluminum sheet is coated with a metal by plating. Prior to plating, the aluminum sheet is usually subjected to pretreatment for plating in a conventional manner, such as by alkaline degreasing followed by pickling. Thus, the aluminum sheet is plated with the metal immediately after it is pickled to remove the oxide film formed on the surface. The resulting plated metal coating prevents the regeneration of an oxide film during storage, which adversely affects the spot weldability.

The metal with which aluminum sheet is plated should have a melting point of at least about 700° C. If the melting point of the metal is lower than about 700° C., as is the case with pure Z, the plated coating in the weld zone will be melted prior to or almost simultaneously with melting of Al during spot welding, thereby diffusing the current and decreasing the spot weldability. In addition, the melt penetrates into the surface area of the electrodes and forms a brittle intermetallic compound between the metals of the plated coating and the electrodes, thereby accelerating the consumption of the electrodes. In contrast, a plated coating having a melting point of about 700° C. or above is not significantly melted by the heat of spot welding and the above-described problems can be avoided.

Examples of a metal which has a melting point of about 700° C. or above and which is useful for plating in this invention include Cr, Mn, Fe, Co, and Ni metals and alloys of two or more of these metals, as well as alloys of Zn with at least one of these metals.

These metals are less active than aluminum and the surface of the plated coating can be effectively protected against the formation of an oxide film by a simple protecting means such as application of a rust-preventing oil, thereby preventing a loss of spot weldability caused by the formation of an oxide film.

Furthermore, a plated coating of the above-described metal generally has a higher electric resistivity and lower thermal conductivity than Al and therefore has the effect of decreasing the welding current. Since the plated coating is not substantially melted upon application of welding current, the value for contact resistance does not vary significantly throughout welding, thereby enabling the improved spot weldability to be maintained.

In addition, the plated coating forms an exposed layer which serves as a barrier to prevent the aluminum sheet from directly contacting the electrodes of a spot welder and to prevent the formation of a brittle Cu—Al intermetallic compound during spot welding, which accelerates the consumption of the electrodes. As a result, the service life of the electrodes is improved. Particularly when the plated coating is nickel or an Ni-containing alloy such as a Zn—Ni alloy, Ni slightly diffuses into the surface of the chip electrodes of a spot welder, thereby suppressing the degradation of the chip electrodes caused by the formation of brittle Cu—Al or Cu—Zn alloys.

A further advantage is that the plated coating generally has a hardness higher than that of the aluminum sheet and it provides the resulting plated aluminum sheet with improved sliding properties, which lead to improved press-formability.

The metal or alloy composition for the plated coating may be selected so as to provide the plated coating with optimum properties with respect to spot weldability, press-formability, corrosion resistance, and prevention of stray current corrosion with Al. In the case of a plated coating made of an alloy of Zn with one or more metals selected from Cr, Mn, Fe, Co, and Ni, the content of the alloying metal or metals in the coating is not critical as long as the alloy has a melting point of 700° C. or higher. Preferably a plated coating of a Zn—Ni alloy contains at least 5% by weight of Ni and that of a Zn—Fe alloy contains at least 3% by weight of Fe.

The plated coating formed on aluminum sheet preferably has a coating weight in the range of from about 0.1 to about 40 $g/m^2$ and more preferably from about 3 to about 20 $g/m^2$ for single coating, i.e., when it is applied only to one surface of the aluminum sheet. For double coating, i.e., when both surfaces of the aluminum sheet are plated, it is preferred that the plated coating on each surface have a coating weight in the range of from about 0.1 to about 40 $g/m^2$ and more preferably from about 3 to about 20 $g/m^2$ when it is a Zn alloy or in the range of from about 0.1 to about 20 $g/m^2$ and more preferably from about 3 to about 20 $g/m^2$ when it is Cr, Mn, Fe, Co, or Ni metal or an alloy of two or more of these metals.

A coating weight of less than about 0.1 $g/m^2$ is not sufficient to coat the surface of the aluminum sheet completely. Thus, a part of the aluminum surface is exposed on a microscopic scale and it is highly susceptible to oxidation to form an oxide film thereon, thereby degrading the spot weldability.

An extremely thick plated coating having a coating weight exceeding the above-described maximum value is not preferred, since such a thick plated coating tends to suffer from powdering during press-forming and it is disadvantageous from the viewpoint of economy. Furthermore, in the case of double coating, the plated coating on the surface not facing the electrodes is not readily melted during spot welding if it is too thick, resulting in spattering of the Al sheet rather than welding thereof.

In the case of single coating, i.e., when the aluminum sheet is plated on one surface thereof, it is preferred that spot welding of the resulting plated aluminum sheet be performed in such a manner that the plated surface thereof faces away from the other sheet to be welded so that the plated surface is brought into contact with an electrode of the spot welder. If the plated surface of a single-plated aluminum sheet faces the other sheet to be welded or the plated surfaces of two single-plated aluminum sheets face each other during spot welding, the plated coating may not be melted to a degree sufficient to achieve good bonding.

Also, in the case of spot welding of a single-plated aluminum sheet which is hemmed, i.e., by 180° folding, the hemming of the sheet is preferably performed with the plated surface outside so that the non-plated surface is welded.

The resulting contact interface between the non-plated surfaces has a contact resistance higher than that of the contact interface between the plated surface and an electrode of a welder, and therefore heat generation is concentrated at the contact interface between the non-plated surfaces, thereby improving the efficiency of spot welding. In addition, the heat generation at the contact interface between the plated surface and an electrode is suppressed and the service life of the electrode is increased.

The plated aluminum sheet according to the present invention can be produced by subjecting an aluminum sheet prepared by a conventional rolling method to plating after it has been pretreated in a conventional manner, e.g., by alkaline degreasing followed by pickling. The aluminum sheet usually has a thickness in the range of about 0.8 to about 1.6 mm.

The plating method is not critical and any known plating method can be employed. Electroplating, chemical plating, evaporation coating, and vacuum evaporation coating are suitable from the standpoint of productivity. Preferably the plating is performed by electroplating in an acidic plating bath. A sulfate bath is particularly suitable for use in the electroplating.

The plated aluminum sheet according to the present invention has improved spot weldability and press-formability. Therefore, it is particularly suitable for use in the manufacture of automobile bodies such as hoods, doors, and fenders in order to decrease the weight of the automobile bodies.

The following examples are given to further illustrate the invention. In the examples, percents are by weight unless otherwise indicated.

EXAMPLE 1

A 1.0 mm-thick aluminum sheet made of an Al—4.5 Mg alloy suitable for use in the manufacture of automobile hoods was subjected to pretreatment in the following sequence and manner.

(1) Alkaline degreasing: cathodic electrolysis for 6 seconds in an aqueous 7% sodium orthosilicate solution at 80° C.
(2) Rinsing with water.
(3) Pickling: dipping for 5 seconds in a 8% hydrochloric acid solution (pH 1) at 80° C.
(4) Rising with water.

The pretreated aluminum sheet was then electroplated in a sulfate plating bath under the following conditions to form a plated coating having the composition shown in Table 1 on one or both surfaces of the sheet:

Electrodes: SUS 304
Bath temperature: 55° C.
Bath pH: 1.8
Current density: 50 A/dm$^2$.

The spot weldability of each resulting plated aluminum sheet was tested by welding two test pieces thereof using a three-phase AC spot welder equipped with electrodes of a Cu—Cr alloy. The welding conditions were a welding current of 22,000 A, a frequency of 60 Hz, a weld time of 7 cycles, and a welding force of 300 kgf. In the case of a single-coated aluminum sheet having a plated coating only on one surface thereof, spot welding was performed on two test pieces which were superposed so that the plated surface of each test piece faced an electrode of the welder. The tensile shear strength of the weld spots formed in the spot welding test was determined according to JIS Z3136. The average of the measured values for the first ten weld spots was calculate and recorded as the tensile shear strength.

The spot weldability was evaluated in terms of the number of spots weldable in the continuous spot welding test until the tensile shear strength of a weld spot decreased to less than 200 kgf (=1960N). It is desirable that the spot weldability as defined above be at least 350 and preferably at least 450.

The test results are also shown in Table 1 below.

TABLE 1

| Run No. | Plated Coating: Composition (wt %) Cr | Mn | Fe | Co | Ni | Zn | Coating weight[1)] (gm$^2$) | M.P. (°C.) | Tensile shear strength (N/spot) | Spot weldability (No. of spots) | Remarks |
|---|---|---|---|---|---|---|---|---|---|---|---|
| 1 | — | — | — | — | — | — | 0* | — | 3150 | 150 | Unplated |
| 2 | — | — | — | — | — | 100* | 1/1 | 419* | 2950 | 100 | Zn plating |
| 3 | 100 | — | — | — | — | — | 1/1 | 1905 | 3750 | 700 | This Invent. |
| 4 | — | — | 100 | — | — | — | 0.05/0.05* | 1538 | 3200 | 180 | Comparative |
| 5 | — | — | 100 | — | — | — | 0.2/0.4 | 1538 | 3700 | 1350 | This |
| 6 | — | — | 100 | — | — | — | 1.7/1.8 | 1538 | 3850 | 1400 | Invention |
| 7 | — | — | 100 | — | — | — | 5/5 | 1538 | 3750 | 1550 | |
| 8 | — | 100 | — | — | — | — | 1/1 | 1247 | 3200 | 1500 | |
| 9 | — | — | — | 100 | — | — | 1/1 | 1492 | 3500 | 1950 | |
| 10 | — | — | — | — | 100 | — | 1/1 | 1455 | 3600 | 2000 | |
| 11 | — | — | 15 | — | — | 85 | 1/1 | 782 | 3500 | 1150 | |
| 12 | — | — | — | — | 13 | 87 | 0.3/0.3 | 840 | 3450 | 1250 | |
| 13 | — | — | — | — | 13 | 87 | 1.6/1.8 | 840 | 3500 | 1300 | |
| 14 | — | — | — | — | 13 | 87 | 3/2.5 | 840 | 3550 | 1300 | |
| 15 | — | — | — | — | 3 | 97 | 1/1 | 640* | 3100 | 300 | Comparative |
| 16 | — | 30 | — | — | — | 70 | 1/1 | 836 | 3250 | 900 | This |
| 17 | — | — | — | 4 | — | 96 | 1/1 | 720 | 3250 | 750 | Invention |
| 18 | — | — | — | 4 | — | 96 | 5/5 | 720 | 3300 | 800 | |
| 19 | — | — | — | — | — | 100* | 5/5 | 419* | 2950 | 100 | Zn plating |
| 20 | 100 | — | — | — | — | — | 0/5 | 1905 | 3800 | 800 | This |
| 21 | — | — | 100 | — | — | — | 0/5 | 1538 | 3600 | 1250 | Invention |
| 22 | — | — | 100 | — | — | — | 5/5 | 1538 | 3800 | 1600 | |
| 23 | — | — | 15 | — | — | 85 | 0/5 | 782 | 3450 | 1100 | |
| 24 | — | — | 2 | — | — | 98 | 0/5 | 665* | 3200 | 250 | Comparative |
| 25 | — | — | — | — | 13 | 87 | 5/5 | 840 | 3500 | 1500 | This |
| 26 | — | — | — | — | 13 | 87 | 0/5 | 840 | 3500 | 1400 | Invention |
| 27 | — | — | — | — | 13 | 87 | 0/0.05* | 840 | 3100 | 150 | Comparative |
| 28 | — | — | — | — | 13 | 87 | 0/0.2 | 840 | 3250 | 400 | This |

TABLE 1-continued

| Run No. | Plated Coating Composition (wt %) Cr | Mn | Fe | Co | Ni | Zn | Coating weight[1)] (gm²) | M.P. (°C.) | Tensile shear strength (N/spot) | Spot weld-ability (No. of spots) | Remarks |
|---|---|---|---|---|---|---|---|---|---|---|---|
| 29 | — | — | — | — | 10 | 90 | 0/5 | 790 | 3350 | 1250 | Invention |
| 30 | — | — | — | — | 3 | 97 | 0/5 | 640* | 3100 | 300 | Comparative |
| 31 | — | 30 | — | — | — | 70 | 0/5 | 836 | 3400 | 850 | This |
| 32 | — | — | — | 4 | — | 96 | 0/5 | 720 | 3250 | 900 | Invention |
| 33 | — | — | — | 4 | — | 96 | 5/5 | 720 | 3300 | 900 | |

(Note)
[1)]Coating weight = Front surface/Back surface;
*Outside the range defined herein.

As is apparent from these tables, the plated aluminum sheets according to this invention have significantly improved spot weldability over conventional unplated or zinc-plated aluminum sheets.

EXAMPLE 2

A 1.0 mm-thick aluminum sheet of a JIS 5000-series Al—Mg alloy (Al—4.5 Mg) was electroplated on both surfaces thereof with a Zn—Ni or Zn—Fe alloy in a sulfate plating bath under the following conditions:

Electrodes: SUS 304
Bath temperature: 55°-60° C.
Bath pH: 1.6-2.0
Current density: 50 A/dm².

The resulting plated aluminum sheet was evaluated for spot weldability in the same manner as described in Example 1. The surface sliding properties of the plated aluminum sheet was evaluated by determining the coefficient of surface sliding ($\mu$) by a Bauden test, in which a test piece which was pressed by a steel ball having a 5 mm diameter placed thereon with a force of 5 gf was pulled horizontally in one direction at a speed of 4 mm/sec, and the force F required for pulling was measured. The value of $\mu$ was calculated by the formula: $\mu=F/500$. No oil was applied to the test piece before the test. It is desirable that the coefficient of surface sliding ($\mu$) be 0.50 or lower and preferably 0.45 or lower for good press-formability.

The test results are shown in Table 2 along with the composition of the plated coating.

TABLE 2

| Run No. | Plated Coating (double-coating) Composition (wt %) Zn | Ni | Fe | Coating weight (g/m²) | M.P. (°C.) | Spot weld-ability (No. of spots) | Coeff. of surface sliding ($\mu$) | Remarks |
|---|---|---|---|---|---|---|---|---|
| 1 | — | — | — | 0* | — | 250 | 0.80 | Al sheet |
| 2 | 100 | — | — | 15 | 419* | 400 | 0.50 | Zn plating |
| 3 | 97 | — | 3 | 15 | 660 | 450 | 0.45 | This |
| 4 | 80 | — | 20 | 15 | 1060 | 600 | 0.40 | Invention |
| 5 | 70 | — | 30 | 15 | 1160 | 650 | 0.39 | |
| 6 | 80 | — | 20 | 5 | 1060 | 500 | 0.42 | |
| 7 | 80 | — | 20 | 40 | 1060 | 580 | 0.40 | |
| 8 | 95 | 5 | — | 15 | 660 | 700 | 0.40 | |
| 9 | 88 | 12 | — | 15 | 840 | 1360 | 0.35 | |
| 10 | 80 | 20 | — | 15 | 880 | 1320 | 0.30 | |
| 11 | 88 | 12 | — | 5 | 840 | 800 | 0.38 | |
| 12 | 88 | 12 | — | 40 | 840 | 1320 | 0.34 | |

*Outside the range defined herein.

As is apparent form the results of Table 3, all the plated aluminum sheets according to this invention have improved spot weldability and press-formability.

The principles, preferred embodiments and modes of operation of the present invention have been described in the foregoing specification. The invention, however, is not to be construed as limited to the particular forms disclosed, since these are to be regarded as illustrative rather than restrictive. Variations and modifications may be made by those skilled in the art without departing from the concept of the invention.

What is claimed is:

1. A spot welded plated aluminum sheet having improved spot weldability which comprises an aluminum sheet having on one or both surfaces a plated coating of a metal which has a melting point of about 700° C. or above, the plated coating being present in a thickness sufficient to improve efficiency of spot welding of the aluminum sheet, the plated coating having a higher electric resistivity and lower thermal conductivity than the aluminum sheet, the plated coating having a hardness higher than the aluminum sheet, and the hardness being high enough to improve sliding properties and improve press-formability of the aluminum sheet, the plated coating being a zinc base alloy containing at least one of Cr, Mn, Fe, Co and Ni, the plated coating forming an exposed layer of the plated aluminum sheet.

2. The plated aluminum sheet of claim 1, wherein the plated coating is formed on one surface of the aluminum sheet with a coating weight in the range of from about 0.1 to about 40 g/m².

3. The plated aluminum sheet of claim 2, wherein the plated coating has a coating weight in the range of from about 3 to about 20 g/m².

4. The plated aluminum sheet of claim 1, wherein the plated coating is formed on both surfaces of the aluminum sheet with a coating weight in the range of from about 0.1 to about 20 g/m² on each surface.

5. The plated aluminum sheet of claim 1, wherein the plated coating is formed on both surfaces of the aluminum sheet with a coating weight in the range of from about 0.1 to about 40 g/m$^2$ on each surface.

6. The plated aluminum sheet of claim 1, wherein the plated coating consists essentially of a zinc base alloy containing at least 5% Ni.

7. The plated aluminum sheet of claim 1, wherein the plated coating consists essentially of a zinc base alloy containing at least 3% Fe.

8. The plated aluminum sheet of claim 1, wherein the sheet comprises a body panel of an automobile.

9. The plated aluminum sheet of claim 1, wherein the sheet comprises an engine hood, door or fender of an automobile.

10. The plated aluminum sheet of claim 1, wherein the sheet comprises a press-formed vehicle body panel.

11. A plated aluminum sheet having improved spot weldability which comprises an aluminum sheet having on one or both surfaces a plated coating of a metal which has a melting point of about 700° C. or above, the plated coating being present in a thickness sufficient to improve efficiency of spot welding of the aluminum sheet, the plated coating having a higher electric resistivity and lower thermal conductivity than the aluminum sheet, the plated coating having a hardness higher than the aluminum sheet, and the hardness being high enough to improve sliding properties and improve press-formability of the aluminum sheet, the plated coating being a zinc base alloy containing at least one of Cr, Mn, Fe, CO and Ni, the plated coating forming an exposed layer of the plated aluminum sheet, the plated coating being only on one side of the aluminum sheet and the other side of the aluminum sheet being uncoated, the aluminum sheet being bent 180° and spot welded such that portions of the uncoated side of the aluminum sheet face each other than are spot welded together.

12. A plated aluminum sheet having improved spot weldability which comprises an aluminum sheet having on one or both surfaces a plated coating of a metal which has a melting point of about 700° C. or above, the plated coating being present in a thickness sufficient to improve efficiency of spot welding of the aluminum sheet, the plated coating having a higher electric resistivity and lower thermal conductivity than the aluminum sheet, the plated coating having a hardness higher than the aluminum sheet, and the hardness being high enough to improve sliding properties and improve press-formability of the aluminum sheet, the plated coating being a zinc base alloy containing at least one of Cr, Mn, Fe, Co and Ni, the plated coating forming an exposed layer of the plated aluminum sheet, the plated coating being on one side of the aluminum sheet and the other side of the aluminum sheet being uncoated, the uncoated side of the aluminum sheet being spot welded to an aluminum article.

13. A plated aluminum sheet having improved spot weldability which comprises an aluminum sheet having on one or both surfaces a plated coating of a metal which has a melting point of about 700° C. or above, the plated coating being present in a thickness sufficient to improve efficiency of spot welding of the aluminum sheet, the plated coating having a higher electric resistivity and lower thermal conductivity than the aluminum sheet, the plated coating having a hardness higher than the aluminum sheet, and the hardness being high enough to improve sliding properties and improve press-formability of the aluminum sheet, the plated coating being a zinc base alloy containing at least one of Cr, Mn, Fe, Co and Ni, the plated coating forming an exposed layer of the plated aluminum sheet, the sheet comprising a press-formed and spot welded vehicle body panel.

* * * * *